US010606186B1

(12) United States Patent
Mizuno

(10) Patent No.: US 10,606,186 B1
(45) Date of Patent: Mar. 31, 2020

(54) IMAGE FORMING APPARATUS THAT INCLUDES AT LEAST TWO TONER CARTRIDGE HOUSING SECTIONS AND IMAGE FORMING METHOD FOR THE SAME

(71) Applicant: TOSHIBA TEC KABUSHIKI KAISHA, Shinagawa-ku, Tokyo (JP)

(72) Inventor: Masanaka Mizuno, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/229,003

(22) Filed: Dec. 21, 2018

(51) Int. Cl.
*G03G 15/08* (2006.01)

(52) U.S. Cl.
CPC ..... *G03G 15/0856* (2013.01); *G03G 15/0868* (2013.01)

(58) Field of Classification Search
CPC ..... G03G 15/0856; G03G 21/1875–1896
USPC ..... 399/12, 27
See application file for complete search history.

(56) References Cited

U.S. PATENT DOCUMENTS 6,912,366 B1 * 6/2005 Yamamoto ..... G03G 21/1889 399/25
8,594,516 B2 * 11/2013 Takahashi ..... G03G 15/08 399/12

FOREIGN PATENT DOCUMENTS

JP 2004-62078 2/2004
JP 2004-93693 3/2004

* cited by examiner

*Primary Examiner* — Walter L Lindsay, Jr.
*Assistant Examiner* — Arlene Heredia
(74) *Attorney, Agent, or Firm* — Amin, Turocy & Watson, LLP

(57) ABSTRACT

In accordance with an embodiment, an image forming apparatus comprises an image forming section configured to form an image using a toner supplied from a toner cartridge; a remaining amount acquisition section configured to acquire a remaining amount of the toner in the toner cartridge; a determining section configured to determine whether or not the toner cartridge satisfies a predetermined condition; and a deciding section configured to decide a toner cartridge to be subjected to determination processing by the determining section based on the remaining amount.

4 Claims, 7 Drawing Sheets

FIG.4

910

| CARTRIDGE ID | HOUSING SECTION ID | CARTRIDGE MAXIMUM VALUE |
|---|---|---|
| TON1-1 | A1 | 500ML |
| TON1-2 | A1 | 600ML |
| TON1-3 | A1 | 750ML |
| TON2-1 | A2 | 450ML |
| … | … | … |

911

FIG.5

920

| HOUSING SECTION ID | REMAINING AMOUNT RATIO |
|---|---|
| A1 | 22% |
| A2 | 37% |
| A3 | 9% |
| A4 | 50% |
| A5 | 45% |
| … | … |

921

IMAGE FORMING APPARATUS THAT INCLUDES AT LEAST TWO TONER CARTRIDGE HOUSING SECTIONS AND IMAGE FORMING METHOD FOR THE SAME

FIELD

Embodiments described herein relate generally to an image forming apparatus and an image forming method.

BACKGROUND

The presence of counterfeit toner cartridges or toner cartridges not specifically designed for a given image forming apparatus can be detrimental to the operation of the image forming apparatus. In a conventional image forming apparatus, the processing of determining whether or not all toner cartridges mounted in the image forming apparatus are regular products (that is, toner cartridges that meet the specifications of the image forming apparatus) is performed at the time of startup. Therefore, there is a case in which much time is required for startup of the image forming apparatus.

DESCRIPTION OF THE DRAWINGS

FIG. 4 is a diagram illustrating a specific example of a regular product related information according to the embodiment;

FIG. 5 is a diagram illustrating a specific example of remaining amount information according to the embodiment;

DETAILED DESCRIPTION

In accordance with an embodiment, an image forming apparatus comprises an image forming section configured to form an image using a toner supplied from a toner cartridge; a remaining amount acquisition section configured to acquire a remaining amount of the toner in the toner cartridge; a determining section configured to determine whether or not the toner cartridge satisfies a predetermined condition; and a deciding section configured to decide a toner cartridge to be subjected to determination processing by the determining section based on the remaining amount.

Figure 1:
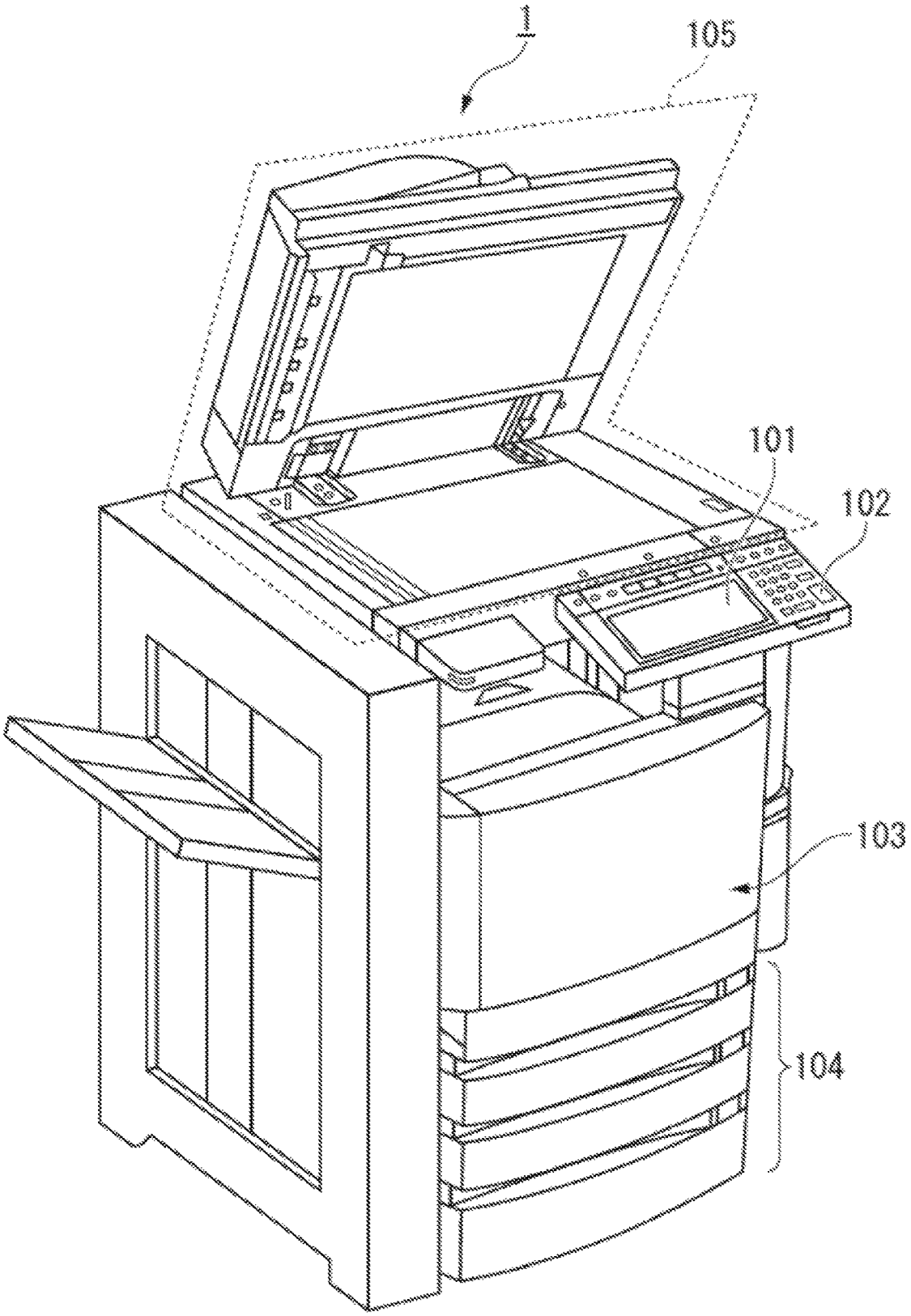
FIG. 1 is an external view illustrating an example of an overall configuration of an image forming apparatus 1 according to an embodiment.

FIG. 1 is an external view illustrating an example of an overall configuration of the image forming apparatus 1 according to the embodiment. The image forming apparatus 1 is, for example, a multifunction peripheral. The image forming apparatus 1 comprises a display 101, a control panel 102, an image forming section 103, a sheet housing section 104 and an image reading section 105. The image forming section 103 of the image forming apparatus 1 may be an apparatus for fixing a toner image or an inkjet type apparatus.

The display 101 is an image display device such as a liquid crystal display or an organic EL (Electro Luminescence) display. The display 101 displays various kinds of information relating to the image forming apparatus 1.

The control panel 102 has a plurality of buttons. The control panel 102 receives an operation from a user. The control panel 102 outputs a signal corresponding to the operation input by the user to a controller of the image forming apparatus 1. The display 101 and the control panel 102 may be integrated with each other to form a touch panel.

The image forming section 103 forms an image on a sheet based on image information generated by the image reading section 105 or image information received via a communication path. The image forming section 103 forms an image by, for example, the following processing. An image forming section of the image forming section 103 forms an electrostatic latent image on a photoconductive drum based on the image information. The image forming section of the image forming section 103 forms a visible image by attaching developer to the electrostatic latent image. Toner is provided as a specific example of the developer. A transfer section of the image forming section 103 transfers a visible image onto the sheet. A fixing section of the image forming section 103 fixes the visible image on the sheet by applying heat and pressure to the sheet. The sheet on which the image is formed may be a sheet accommodated in the sheet housing section 104 or a manually fed sheet.

The sheet housing section 104 accommodates sheets used for image formation by the image forming section 103.

The image reading section 105 reads image information of a reading object as intensity of light. The image reading section 105 records the read image information. The recorded image information may be transmitted to another information processing apparatus via a network. The recorded image information may be used to form an image on the sheet by the image forming section 103.

Figure 2:
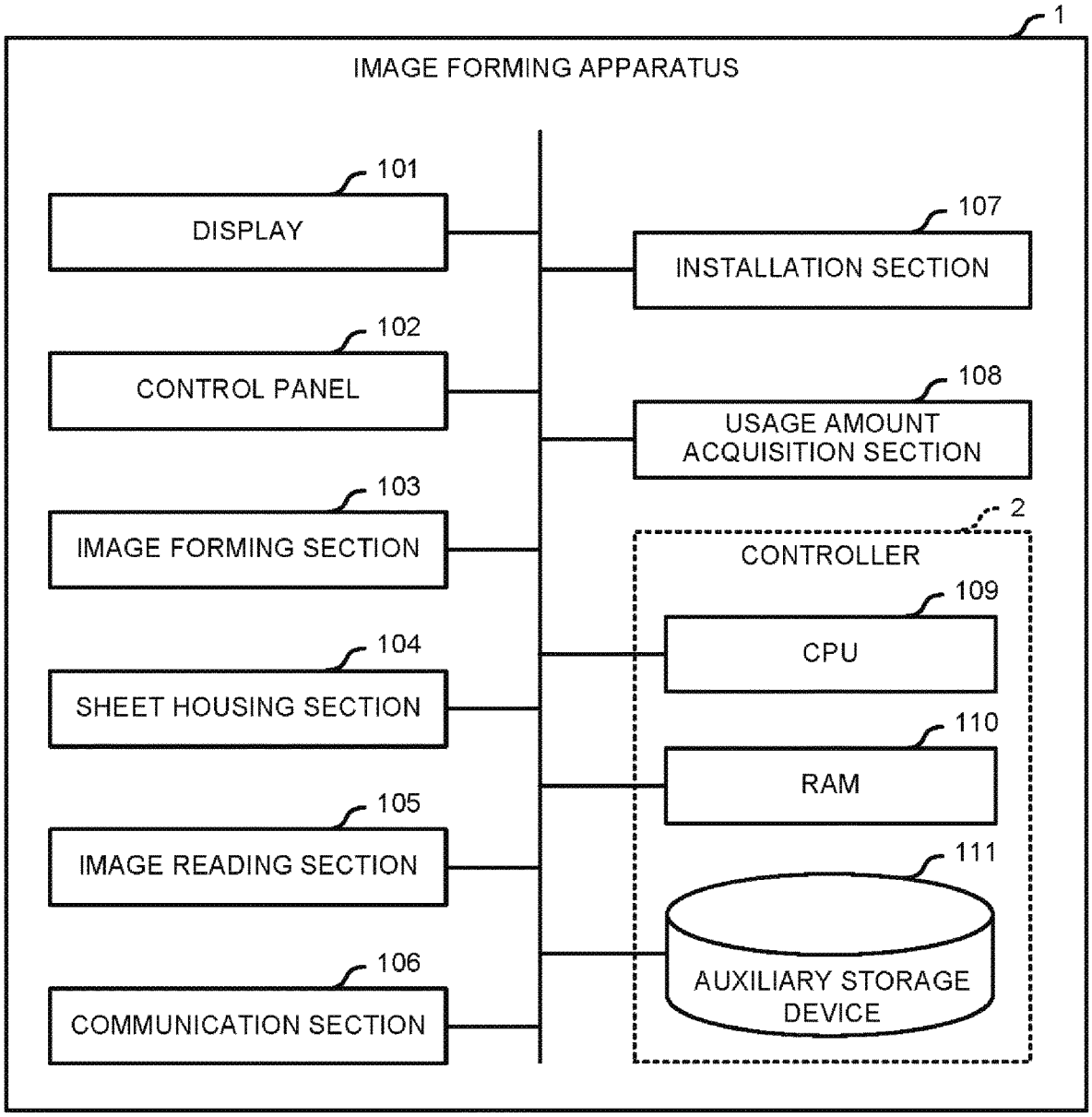
FIG. 2 is a diagram illustrating a specific example of a hardware structure of the image forming apparatus 1.

FIG. 2 is a diagram illustrating a specific example of a hardware structure of the image forming apparatus 1. The image forming apparatus 1 comprises the display 101, the control panel 102, the image forming section 103, the sheet housing section 104, the image reading section 105, a communication section 106, an installation section 107, a usage amount acquisition section 108, a CPU (Central Processing Unit) 109, a RAM (Random Access Memory) 110, and an auxiliary storage device 111, which are connected to each other via a bus. The CPU 109 reads the program stored in the auxiliary storage device 111 into the RAM 110 and executes it, so that a controller 2 is generated. The controller 2 controls the display 101, the control panel 102, the image forming section 103, the sheet housing section 104, the image reading section 105, the communication section 106, the installation section 107 and the usage amount acquisition section 108.

The communication section 106 includes a communication interface for the image forming apparatus 1 to communicate with an external device. The communication section 106 communicates with the external device via a communication interface.

The installation section 107 accommodates a detachable toner cartridge. The installation section 107 includes a cartridge housing section 1071, a cover 1072 and an opening/closing detection sensor 1073. The cartridge housing section 1071 has an opening, and accommodates a detachable toner cartridge 3 inserted through the opening. The cartridge housing section 1071 electrically connects the accommodated toner cartridge 3 to the image forming apparatus 1. The cover 1072 is a lid that closes the opening of the cartridge housing section 1071. The cover 1072 opens and closes at the time of inserting the toner cartridge 3 in the cartridge housing section 1071 and at the time of removing the toner cartridge 3 from the cartridge housing section 1071.

The opening/closing detection sensor 1073 detects opening and closing of the cover 1072. The opening/closing detection sensor 1073 generates information indicating that the cover 1072 is opened (hereinafter, referred to as "opening information") when the cover 1072 is opened. The opening/closing detection sensor 1073 generates information indicating that the cover 1072 is closed (hereinafter, referred to as "closing information") when the cover is closed. The opening/closing detection sensor 1073 may be any type of sensor as long as it can detect the opening and closing of the cover 1072 and then generate the opening information and the closing information. The opening/closing detection sensor may be, for example, a sensor for optically detecting the opening and closing of the cover.

Figure 3:
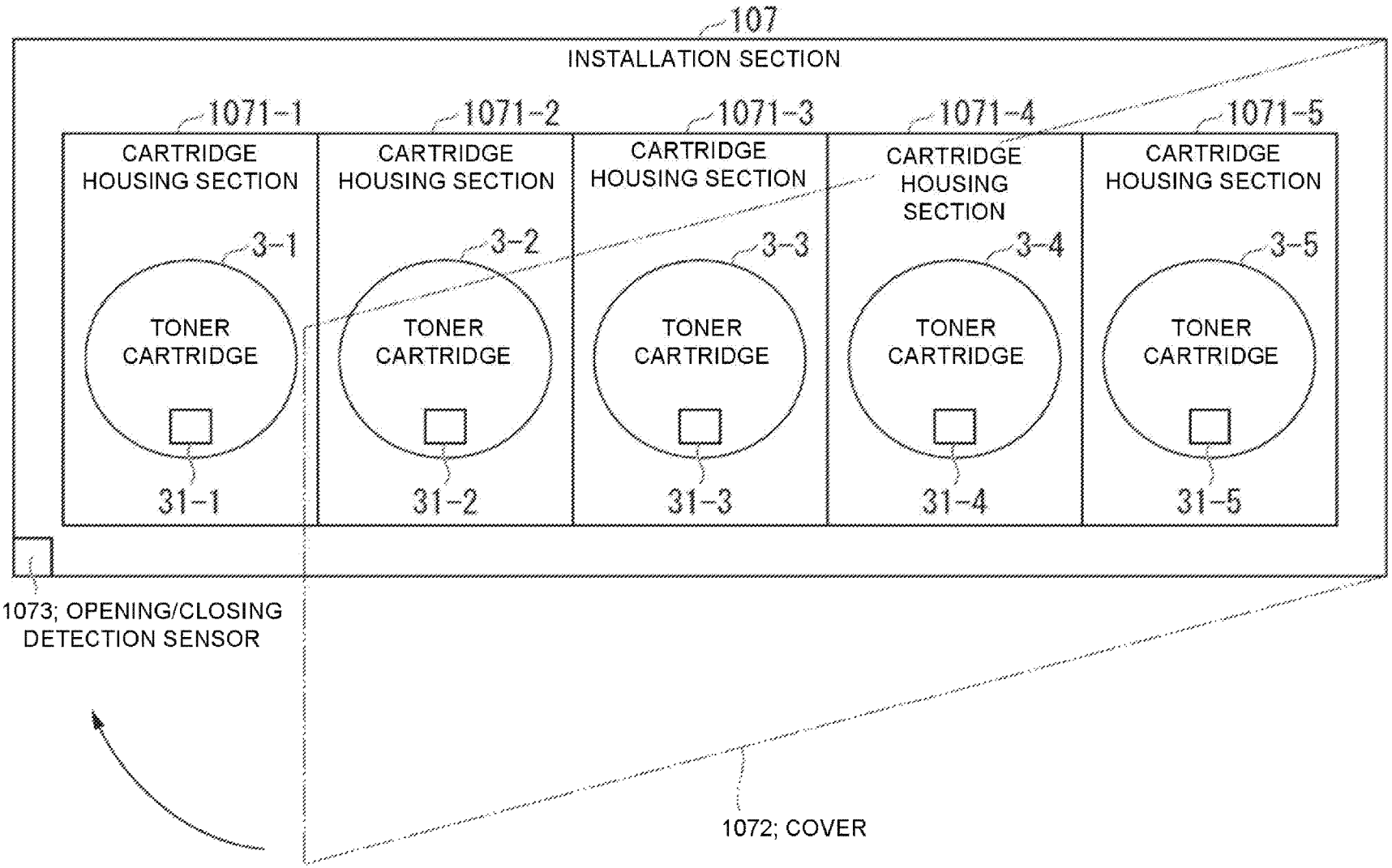
FIG. 3 is a diagram illustrating a specific example of a configuration of an installation section 107 according to the embodiment.

FIG. 3 is a diagram illustrating a specific example of a configuration of the installation section 107 according to the embodiment. The installation section 107 comprises five cartridge housing sections 1071. In the following, the five cartridge housing sections 1071 are distinguished from each other by adding 1, 2, 3, 4, 5 to the reference numerals thereof. For example, a cartridge housing section 1071-1 indicates a first cartridge housing section 1071 among the five ones. The cartridge housing sections 1071-1 to 1071-5 accommodate the toner cartridges 3-1 to 3-5 therein. Hereinafter, the toner cartridges 3-1 to 3-5 are referred to as a toner cartridge 3 if they are not distinguished from each other. The toner cartridges 3-1 to 3-5 include cartridge memories 31-1 to 31-5. Hereinafter, cartridge memories 31-1 to 31-5 are referred to as a cartridge memory 31 if they are not distinguished from each other. The cartridge memory 31 stores identification information for identifying the toner cartridge 3. Hereinafter, the identification information for identifying the toner cartridge 3 is referred to as a cartridge identifier.

The installation section 107 does not necessarily have five cartridge housing sections 1071. The number of the cartridge housing sections 1071 provided in the installation section 107 is not limited as long as the number thereof is one or more.

Returning to the description of FIG. 2. The usage amount acquisition section 108 acquires a usage amount of toner replenished in the toner cartridge 3 accommodated in the cartridge housing section 1071 (hereinafter, referred to as "toner usage amount"). The usage amount acquisition section 108 acquires the toner usage amount in each cartridge. The usage amount acquisition section 108 acquires the toner usage amount at a predetermined timing. The predetermined timing may be any timing. The predetermined timing may be, for example, a timing at which the toner replenished in the toner cartridge 3 is used for image formation. The predetermined timing may be, for example, a predetermined date and time. The usage amount acquisition section 108 acquires the toner usage amount according to a rotation speed of the toner cartridge 3, for example.

The auxiliary storage device 111 is a nonvolatile storage device such as a magnetic hard disk device or a semiconductor storage device. The auxiliary storage device 111 stores regular product related information and remaining amount information. The regular product related information relates to cartridges which are regular products. The regular products are toner cartridges that satisfy predetermined conditions. A regular product is, for example, a toner cartridge 3 whose cartridge identifier is registered in the image forming apparatus 1 in advance.

The remaining amount information relates a remaining amount of the toner replenished in the toner cartridge housing section 1071, and indicates a ratio of remaining amount in the housing section, a housing section identifier, and a relationship therebetween.

FIG. 4 is a diagram illustrating a specific example of the regular product related information according to the embodiment.

The regular product related information indicates the cartridge identifier, the housing section identifier, a cartridge maximum value, and a relationship therebetween. The housing section identifier identifies the cartridge housing section 1071 as a housing destination in which the toner cartridge 3 is accommodated. The cartridge maximum value is a maximum value of the amount of the toner that can be replenished in the toner cartridge 3. The regular product related information is stored in the auxiliary storage device 111, for example, as a regular product related information table 910 shown in FIG. 4. The regular product related information table 910 has a record for each "cartridge ID". Each record has a value of a "cartridge ID", a "housing section ID" and a "cartridge maximum value". The "cartridge ID" indicates a cartridge identifier. The "housing section ID" indicates a housing section identifier. The "cartridge maximum value" indicates a maximum value for the toner cartridge. For example, a record 911 indicates that the housing destination of the toner cartridge 3 whose cartridge identifier is "TON1-1" is the cartridge housing section 1071 whose identifier is "A1". Furthermore, the record 911 indicates that the maximum value of the amount of the toner that can be accommodated in the toner cartridge 3 whose cartridge identifier is TON1-1 is 600 ML.

FIG. 5 is a diagram illustrating a specific example of the remaining amount information according to the embodiment. The remaining amount information is stored in the auxiliary storage device 111 as a remaining amount information table 920 shown in FIG. 5, for example. The remaining amount information table 920 has values of the "housing section ID" and a "remaining amount ratio". The content in the "housing section ID" is the same as that as shown in FIG. 4. The "remaining amount ratio" indicates a housing section ratio. The housing section ratio indicates a ratio of the remaining amount of the toner in the housing section to the cartridge maximum value. The housing section remaining amount indicates a remaining amount of the toner replenished in the toner cartridge 3, and is a value obtained based on the usage amount of the toner acquired by the usage amount acquisition section 108. In FIG. 5, the housing section ratio is a ratio of a difference between the cartridge maximum value and the toner usage amount acquired by the usage amount acquisition section 108 to the cartridge maximum value. For example, a record 921 indicates that the housing section remaining amount ratio of the cartridge housing section 1071 whose cartridge identifier is A3 is 9%.

Figure 6:
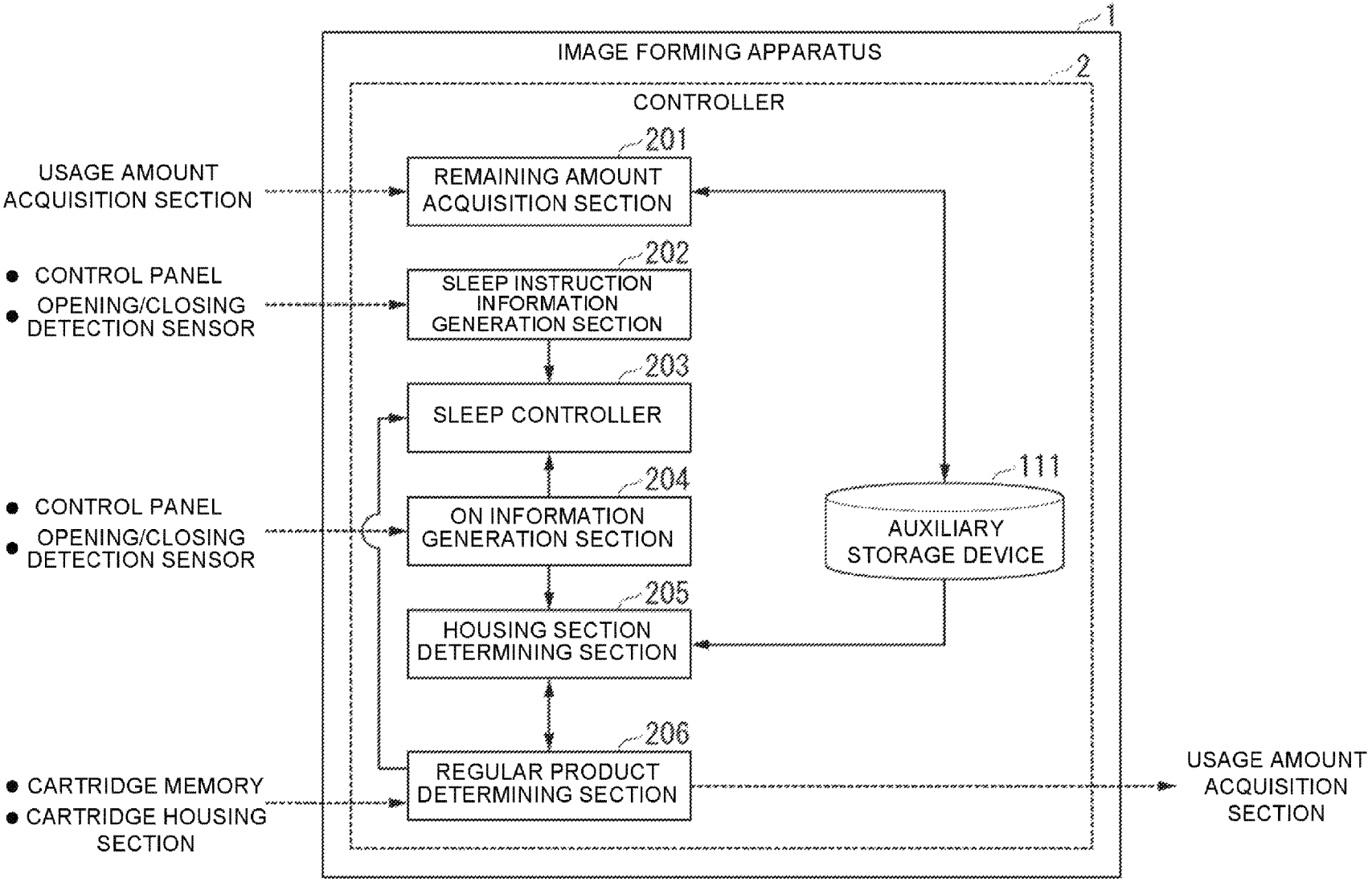
FIG. 6 is a diagram illustrating a specific example of functional components of the image forming apparatus 1 according to the embodiment.

FIG. 6 is a diagram illustrating a specific example of the functional components of the image forming apparatus 1 according to the embodiment. FIG. 6 shows functional units involved in a processing of determining whether or not the toner cartridge 3 is a regular product. The functional units involved in other processing by the image forming apparatus 1 are not shown in FIG. 6.

The image forming apparatus 1 comprises a remaining amount acquisition section 201, a sleep instruction information generation section 202, a sleep controller 203, an ON information generation section 204, a housing section determining section 205 and a regular product determining section 206.

The remaining amount acquisition section 201 acquires the housing section remaining amount and the housing section remaining amount ratio based on the toner usage amount acquired by the usage amount acquisition section 108. Specifically, the remaining amount acquisition section 201 calculates the housing section remaining amount by performing the following processing. First, the remaining amount acquisition section 201 acquires the toner usage amount for each cartridge housing section 1071 acquired by the usage amount acquisition section 108. Next, the remaining amount acquisition section 201 acquires the cartridge identifier of the toner cartridge 3 accommodated in the cartridge housing section 1071 for each cartridge housing section 1071. The remaining amount acquisition section 201 refers to the regular product related information to acquire the cartridge maximum value associated with the acquired cartridge identifier for each cartridge housing section 1071. Finally, the remaining amount acquisition section 201 calculates a difference between the acquired cartridge maximum value and the acquired toner usage amount. In this way, the remaining amount acquisition section 201 calculates the housing section remaining amount. Furthermore, the remaining amount acquisition section 201 calculates a ratio of the housing section remaining amount to the acquired cartridge maximum value for each cartridge housing section 1071. In this way, the remaining amount acquisition section 201 calculates the housing section remaining amount ratio. The remaining amount acquisition section 201 records the calculated housing section remaining amount ratio in the auxiliary storage device 111.

The sleep instruction information generation section 202 generates sleep instruction information at a predetermined timing and outputs the generated sleep instruction information to the sleep controller. The predetermined timing refers to a timing when a predetermined condition for changing a state of the image forming apparatus 1 to a state in which the toner cartridge 3 can be replaced is satisfied. The sleep instruction information is a signal indicating that an instruction for changing the state of the image forming apparatus 1 to the state in which the toner cartridge 3 can be replaced is input to the image forming apparatus 1. For convenience of description, in the following description, the state in which the toner cartridge 3 can be replaced is assumed as a sleep state. However, the state in which the toner cartridge 3 can be replaced is not necessarily restricted to the sleep state. The state in which the toner cartridge 3 can be replaced may be, for example, a state in which the image forming apparatus 1 does not consume electric power (hereinafter, referred to as an "OFF state").

In the sleep state, the electric power is supplied only to some functional units of the image forming apparatus 1, and the consumption of the electric power by the image forming apparatus 1 is suppressed. For example, the sleep state is a state in which the electric power consumed by the image forming section 103 is lower than that consumed by the functional units other than the image forming section 103 among the functional units of the image forming apparatus 1. A predetermined condition for the image forming apparatus 1 to shift to the sleep state is, for example, a condition that there is no input to the image forming apparatus 1 for a predetermined period of time.

The sleep controller 203 acquires the sleep instruction information generated by the sleep instruction information generation section 202 and changes the state of the image forming apparatus 1 to the sleep state.

The ON information generation section 204 generates ON information when a predetermined condition for changing the state of the image forming apparatus 1 in the sleep state to a startup state is satisfied. The startup state is a state in transition in which the image forming apparatus 1 in the sleep state or the OFF state shifts to the ON state. The ON state is a state in which the electric power supplied to the image forming section 103 is a predetermined electric power larger than that supplied when the image forming section 103 is in the sleep state and the OFF state. The predetermined condition for the image forming apparatus 1 to shift to the startup state may be, for example, a timing when the cover 1072 is closed. When the cover 1072 is closed, the opening/closing detection sensor 1073 generates the closing information. The ON information generation section 204 acquires the generated closing information. The predetermined condition for changing the state of the image forming apparatus 1 to the startup state may be a condition that there is an input to the image forming apparatus 1 in the sleep state. The ON information indicates that a predetermined condition for the image forming apparatus 1 in the sleep state to shift to the startup state is satisfied.

The ON information generation section 204 outputs the generated ON information to the sleep controller 203 and the housing section determining section 205.

Based on the housing section remaining amount stored in the auxiliary storage device 111, the housing section determining section 205 determines whether or not a predetermined cartridge housing section 1071 satisfies a predetermined condition. Hereinafter, the processing of determining whether or not a predetermined cartridge housing section 1071 satisfies a predetermined condition is referred to as a housing section determination processing. The predetermined condition may be any condition as long as it indicates that the remaining amount of the toner in the toner cartridge 3 immediately before entering the sleep state is equal to or less than a predetermined value. The predetermined condition may be, for example, a condition that the housing section remaining amount ratio associated with the cartridge housing section 1071 is equal to or less than a predetermined value.

Hereinafter, the cartridge housing section 1071 which is determined to be the cartridge housing section 1071 satisfying the predetermined condition is referred to as a target housing section.

The regular product determining section 206 determines whether or not the toner cartridge 3 accommodated in the target housing section is a regular product (a regular product is a genuine product or an OEM product, and not a counterfeit product). Hereinafter, the processing of determining whether or not the toner cartridge 3 is a regular product is referred to as a regular product determination processing.

Figure 7:
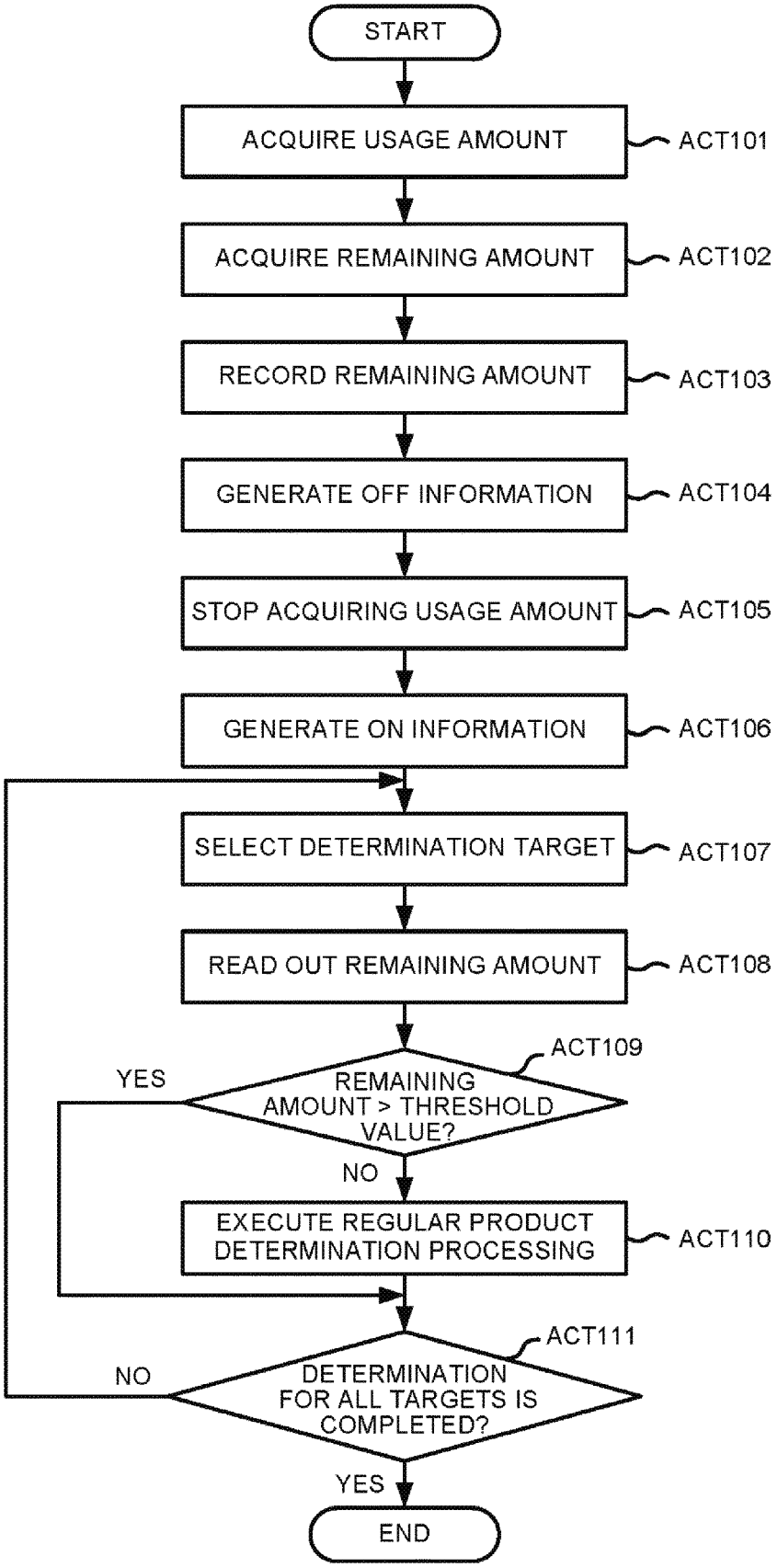
FIG. 7 is a flowchart depicting a flow of a specific processing for determining whether a toner cartridge 3 is a regular product or not in the image forming apparatus 1 according to the embodiment.

FIG. 7 is a flowchart depicting a flow of a specific processing for the image forming apparatus 1 to determine whether or not the toner cartridge 3 is a regular product according to the embodiment.

The usage amount acquisition section 108 acquires the toner usage amount for each cartridge housing section 1071 (ACT 101). The remaining amount acquisition section 201 acquires the housing section remaining amount for each cartridge housing section 1071 (ACT 102). The remaining amount acquisition section 201 updates the housing section remaining amount indicated by the remaining amount information stored in the auxiliary storage device 111 according to the housing section remaining amount acquired in the ACT 102 (ACT 103).

The sleep instruction information generation section 202 generates the sleep information when the predetermined condition for changing the state of the image forming apparatus 1 to a state in which the toner cartridge 3 can be replaced is satisfied (ACT 104). The sleep controller 203 acquiring the sleep information changes the state of the image forming apparatus 1 to the sleep state (ACT 105). Through the processing in ACT 104 and ACT 105, the image forming apparatus 1 enters the sleep state. In the sleep state, the usage amount acquisition section 108 stops acquisition of the toner usage amount. If the predetermined condition for changing the state of the image forming apparatus 1 to the startup state is satisfied, the ON information generation section 204 generates ON information (ACT 106). The ON information generation section 204 outputs the generated ON information to the sleep controller 203 and the housing section determining section 205. The sleep controller 203 acquiring the ON information changes the state of the image forming apparatus 1 to the startup state. The housing section determining section 205 acquiring the ON information selects the cartridge housing section 1071 as a determination target of the housing section determination processing with a predetermined method (ACT 107). By referring to the remaining amount information, the housing section determining section 205 reads out the housing section remaining amount associated with the cartridge housing section 1071 selected in ACT 107 (ACT 108). The housing section determining section 205 determines whether or not the read housing section remaining amount is larger than a predetermined value (hereinafter, referred to as a "threshold value") (ACT 109). If the housing section remaining amount is equal to or smaller than the threshold value (No in ACT 109), the regular product determining section 206 executes the regular product determination processing on the toner cartridge 3 accommodated in the cartridge housing section 1071 selected in the ACT 107 (ACT 110). The regular product determination processing may be any processing as long as it can determine that the toner cartridge 3 accommodated in the cartridge housing section 1071 selected in the ACT 107 is a regular product. For example, the regular product determination processing may be the following processing. The regular product determining section 206 acquires the cartridge identifier of the toner cartridge 3 accommodated in the cartridge housing section 1071 selected in the ACT 107 from the cartridge memory 31. The regular product determining section 206 refers to the regular product related information to determine whether or not the acquired cartridge identifier is present in the cartridge identifier indicated by the regular product related information. If the acquired cartridge identifier is not present, the regular product determining section 206 determines that the toner cartridge 3 accommodated in the cartridge housing section 1071 selected in ACT 107 is not a regular product. On the other hand, if the acquired cartridge identifier is present, the regular product determining section 206 further refers to the regular product related information to acquire the housing section identifier associated with the acquired cartridge identifier. The regular product determining section 206 determines whether or not the acquired housing section identifier is coincident with the housing section identifier of the cartridge housing section 1071 selected in ACT 107. If they are coincident, the regular product determining section 206 determines that the toner cartridge 3 accommodated in the cartridge housing section 1071 selected in ACT 107 is a regular product. On the other hand, if they are not coincident, the regular product determining section 206 determines that the toner cartridge 3 accommodated in the cartridge housing section 1071 selected in ACT 107 is not a regular product.

After ACT 110, the regular product determining section 206 executes a processing for determining whether the determination for all the cartridge housing sections 1071 is completed (ACT 111). The above processing is a processing of determining whether or not the housing section determination processing is executed for all the cartridge housing sections 1071. If the determination result of the above processing indicates that the determination for all the cartridge housing sections 1071 is not completed (No in ACT 111), the housing section determining section 205 selects the cartridge housing section 1071 to which the housing section determination processing is not executed according to a predetermined method. The result indicating incompletion indicates that the housing section determination processing is not executed for all the cartridge housing sections 1071. Hereinafter, according to the processing in ACT 108 and ACT 109, the housing section determining section 205 performs the housing section determination processing on the selected cartridge housing section 1071.

On the other hand, if the determination result in ACT 111 indicates the determination for all the cartridge housing sections 1071 is completed (Yes in ACT 111), the image forming apparatus 1 terminates the processing and enters the ON state. The result indicating the completion indicates that the housing section determination processing has been executed for all the cartridge housing sections 1071.

On the other hand, in ACT 109, if the housing section remaining amount is larger than the threshold value (Yes in ACT 109), the regular product determination processing is not executed and the processing in ACT 111 is directly performed.

The predetermined method in ACT 107 may be, for example, a method of selecting the cartridge housing sections 1071 in order based on numbers assigned to the cartridge housing sections 1071 in advance.

The image forming apparatus 1 of the embodiment configured as described above selects the toner cartridge 3 to be subjected to the regular product determination processing based on the information indicating the remaining amount of the toner. Therefore, it is possible to suppress an increase in the time taken to start the image forming apparatus 1.

(Modification)

The image forming apparatus 1 does not necessarily determine whether or not the toner cartridge 3 is a regular product according to the processing flow shown in FIG. 7 as long as it can determine whether or not the toner cartridge 3 is a regular product.

For example, before the regular product determination processing is executed, the housing section determining section 205 may determine whether or not the remaining amount of the toner exceeds a threshold value for all the cartridge housing sections 1071.

The housing section determining section 205 may select at least one of the cartridge housing sections 1071 as a determination target of the regular product determining section 206 in the following cases. For example, the determination result of the determination for all the cartridge housing sections 1071 may indicate that the remaining amount of the toner exceeds the threshold value. In such a case, a predetermined number of the cartridge housing sections 1071 may be determined as the determination targets of the regular product determining section 206 among the cartridge housing sections 1071 in which the remaining amount of the toner is low.

Figure 8:
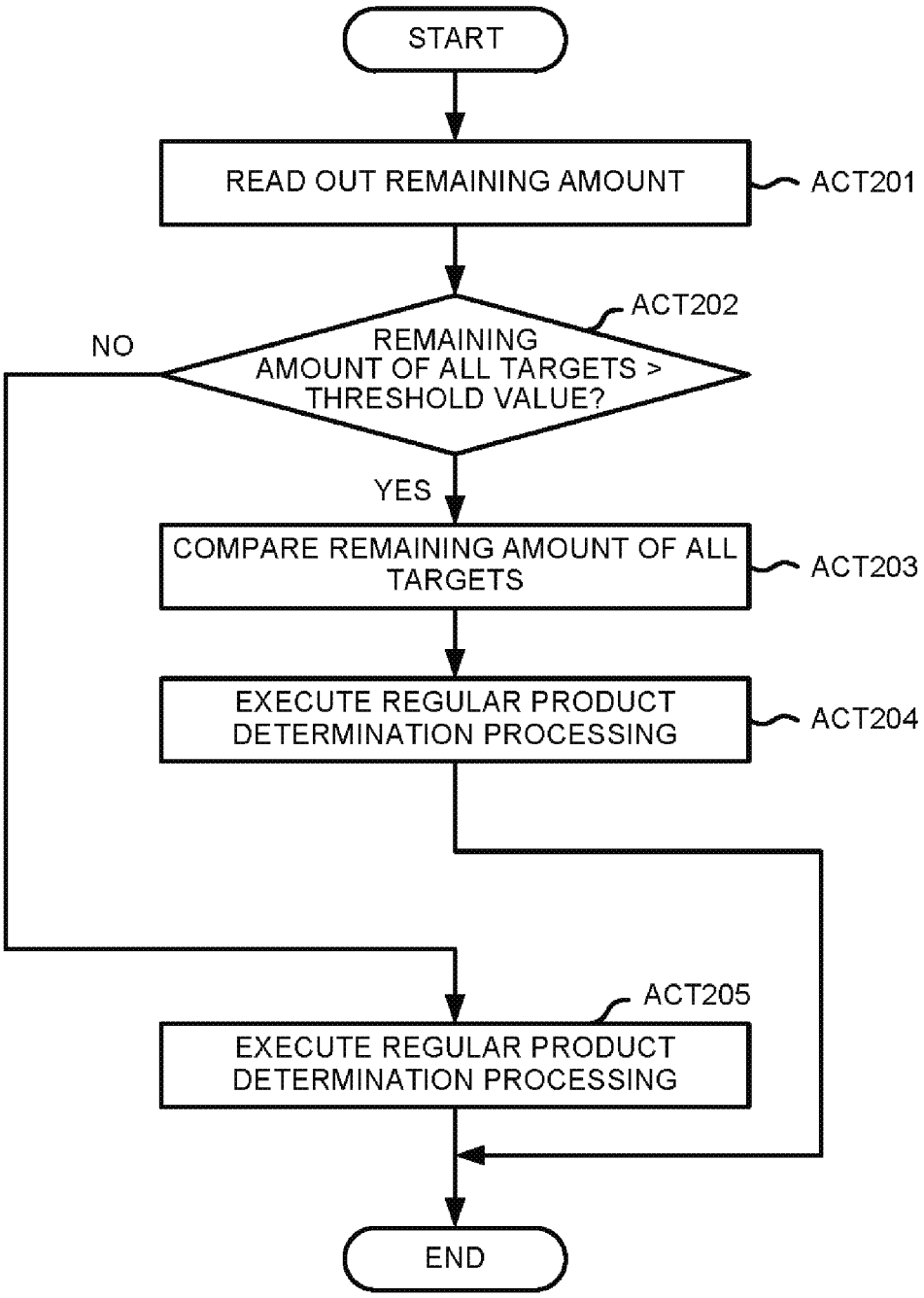
FIG. 8 is a flowchart depicting a flow of a specific processing for determining whether or not a toner cartridge is a regular product in an image forming apparatus 1 according to a modification.

FIG. 8 is a flowchart depicting a flow of a specific processing for determining whether or not the toner cartridge 3 is a regular product in the image forming apparatus 1 according to the modification.

The housing section determining section 205 refers to the remaining amount information to acquire the housing section remaining amount associated with all the cartridge housing sections 1071 (ACT 201). The housing section determining section 205 determines whether or not all of the acquired housing section remaining amount is larger than a threshold value (ACT 202). If all of the housing section remaining amount is larger than the threshold value (Yes in ACT 202), the housing section determining section 205 refers to the remaining amount information to select the cartridge housing section 1071 with the fewest housing section remaining amount (ACT 203). The regular product determining section 206 executes the regular product determination processing on the toner cartridge 3 accommodated in the cartridge housing section 1071 selected in ACT 203 (ACT 204). On the other hand, in ACT 202, if the housing section remaining amount that is equal to or less than the threshold value is present (No in ACT 202), the regular product determining section 206 executes the following processing. The regular product determining section 206 executes the regular product determination processing only on the toner cartridge 3 accommodated in the cartridge housing section 1071 corresponding to the housing section remaining amount equal to or less than the threshold value (ACT 205).

In the processing flow in FIG. 8, the housing section determining section 205 does not necessarily select only the cartridge housing section 1071 with the fewest housing section remaining amount. The housing section determining section 205 may select a predetermined number of the cartridge housing sections 1071 from the ones with few housing section remaining amount.

The remaining amount acquisition section 201 does not necessarily acquire the housing section remaining amount based on the toner usage amount. For example, the remaining amount acquisition section 201 may acquire a value measured by a measuring device as the housing section remaining amount if the image forming apparatus 1 comprises the measuring device for measuring the remaining amount of the toner. The device for measuring the remaining amount of the toner may be, for example, a device for measuring a weight of the toner cartridge 3. The device for measuring the remaining amount of the toner may be a device for measuring the amount of the toner by observing the inside of the toner cartridge 3 with electromagnetic waves such as terahertz waves, for example.

The auxiliary storage device 111 is an example of a toner remaining amount storage section. The remaining amount acquisition section 201 is an example of the toner remaining amount acquisition section. The housing section determining section 205 is an example of a toner cartridge deciding section. The regular product determining section 206 is an example of a toner cartridge determining section.

All or a part of the functions of the image forming apparatus 1 may be realized by using hardware such as an ASIC (Application Specific Integrated Circuit), a PLD (Programmable Logic Device) or a FPGA (Field Programmable Gate Array). The program may be recorded on a computer-readable recording medium. The computer-readable recording medium is, for example, a portable medium such as a flexible disk, a magneto-optical disk, a ROM (Read Only Memory), a CD-ROM (Compact Disc Read-Only Memory) or the like, or a storage device such as a hard disk built in the computer system. The program may be transmitted via an electric communication line.

According to at least one embodiment described above, the image forming apparatus 1 selects the toner cartridge 3 to be subjected to the regular product determination processing based on the information indicating the remaining amount of the toner. Therefore, it is possible to suppress an increase in the time taken to start the image forming apparatus 1.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. An image forming apparatus, comprising:

an image forming section configured to form an image using a toner supplied from a toner cartridge;

a remaining amount acquisition section configured to acquire a remaining amount of the toner in the toner cartridge;

a determining section configured to determine whether or not the toner cartridge is a regular toner cartridge;

a deciding section configured to decide the toner cartridge to be subjected to a determination processing by the determining section based on the remaining amount; and two or more toner cartridge housing sections for accommodating toner cartridges, wherein the remaining amount acquisition section acquires a remaining amount of toner in each toner cartridge accommodated in the two or more toner cartridge housing sections, the deciding section selects only a predetermined number of the toner cartridge housing sections for accommodating the toner cartridges with remaining amounts of the toner acquired by the remaining amount acquisition section being less than a threshold value when a power supply of the image forming apparatus is turned off from the toner cartridge housing sections corresponding to the remaining amounts of the toner being less than the threshold value, and the deciding section further identifies the toner cartridge selected by the deciding section as a target of determination processing by the determining section when the power supply of the image forming apparatus is turned on.

2. The image forming apparatus according to claim 1, wherein the deciding section identifies all toner cartridges as targets of the determination processing by the determining section before the determination processing by the determining section is executed.

3. An image forming apparatus comprising:

an image forming section configured to form an image using a toner supplied from a toner cartridge;

a remaining amount acquisition section configured to acquire a remaining amount of the toner in the toner cartridge;

a determining section configured to determine whether or not the toner cartridge is a regular toner cartridge;

a deciding section configured to decide the toner cartridge to be subjected to a determination processing by the determining section based on the remaining amount; and two or more toner cartridge housing sections for accommodating toner cartridges, wherein the remaining amount acquisition section acquires a remaining amount of toner in each toner cartridge accommodated in the toner cartridge housing sections, the deciding section selects only a predetermined number of toner cartridge housing sections for accommodating the toner cartridges with remaining amounts of the toner acquired by the remaining amount acquisition section being less than a threshold value when the image forming apparatus shifts to a sleep state from the toner cartridge housing sections corresponding to the remaining amounts of the toner being less than the threshold value, and the deciding section further decides the toner cartridge selected by the deciding section as a target of determination processing by the determining section when a power supply of the image forming apparatus supplies larger electric power than an electric power supplied to the image forming apparatus in the sleep state.

4. An imaging forming method, comprising:

forming an image using a toner supplied from a toner cartridge;

acquiring a remaining amount of the toner in the toner cartridge;

determining whether or not the toner cartridge is a regular toner cartridge;

deciding the toner cartridge to be subjected to a determination processing based on the remaining amount; and accommodating toner cartridges with the use of two or more toner cartridge housing sections, wherein the acquiring the remaining amount of the toner comprises acquiring a remaining amount of toner in each toner cartridge accommodated in the toner cartridge housing sections, wherein the deciding the toner cartridge to be subjected to the determination processing comprises selecting only a predetermined number of toner cartridge housing sections for accommodating the toner cartridges with remaining amounts of the toner acquired being less than a threshold value when an image forming apparatus shifts to a sleep state from the toner cartridge housing sections corresponding to the remaining amounts of the toner being less than the threshold value, and wherein the deciding the toner cartridge to be subjected to the determination processing further comprises deciding the toner cartridge accommodated in the toner cartridge housing section as a target of determination processing when a power supply of the image forming apparatus supplies larger electric power than an electric power supplied to the image forming apparatus in the sleep state.

* * * * *